US006682305B1

(12) United States Patent
Lim

(10) Patent No.: US 6,682,305 B1
(45) Date of Patent: Jan. 27, 2004

(54) AUTO MOVABLE ELECTRIC FAN

(76) Inventor: Chea Duk Lim, Suite A-101, Uhjin villige, Sinwol-5dong 1-6, Yangchen-ku, Seoul (KR)

( * ) Notice: Subject to any disclaimer, the term of this patent is extended or adjusted under 35 U.S.C. 154(b) by 74 days.

(21) Appl. No.: 10/111,111

(22) PCT Filed: Aug. 26, 2000

(86) PCT No.: PCT/KR00/00959

§ 371 (c)(1),
(2), (4) Date: Apr. 22, 2002

(87) PCT Pub. No.: WO02/18795

PCT Pub. Date: Mar. 7, 2002

(51) Int. Cl.[7] ..... F01D 25/00
(52) U.S. Cl. ..... 416/170 R; 416/246; 417/423.14
(58) Field of Search ..... 416/170 R, 61, 416/246, 244, 247 R; 417/423.14, 234, 423.1

(56) References Cited

U.S. PATENT DOCUMENTS 3,840,922 A * 10/1974 Morrison et al. ..... 5/350
4,180,376 A 12/1979 Iwaki et al.
4,867,647 A 9/1989 Chow
4,984,761 A 1/1991 Chen
5,429,359 A * 7/1995 Timperman et al. ..... 273/126
5,522,704 A * 6/1996 Casteel ..... 416/246
5,766,085 A * 6/1998 Knez ..... 473/132
5,868,189 A 2/1999 Jarvis
6,111,563 A * 8/2000 Hines ..... 345/166

* cited by examiner

*Primary Examiner*—Edward K. Look
*Assistant Examiner*—J. M. McAleenan
(74) *Attorney, Agent, or Firm*—Mathews, Collins, Shepherd & McKay, P.A.

(57) ABSTRACT

The present invention relates to an electric fan moving automatically, and provides driving means which comprises a driving ball (10) for moving the fan body (100); at least four driving rollers (11) disposed around the driving ball (10), and a motor (12) and a coil (14) for operating the driving rollers (11) selectively, so that the fan could be moved to the desired position conveniently with only a selective control of the power transmission between the driving ball (10) and driving rollers (11) by simple operation of a remote controller. Therefore, the convenience in using the fan is increased and thereby the entire value of the fan is also increased.

5 Claims, 9 Drawing Sheets

AUTO MOVABLE ELECTRIC FAN

TECHNICAL FIELD

The present invention relates to an electric fan for moving automatically, more specifically the electric fan, in which at least four driving roller for transmitting the power to the driving ball and a motor for operating these driving rollers, are disposed around the driving ball in order to move the fan body and the fan body could be moved to the desired position conveniently by controlling each driving roller with the predetermined operation of the remote controller, so that the convenience in using the fan is increased and thereby the entire value of the fan is also increased.

BACKGROUND ART

Generally, most of electric fans for home or store are used, set on suitable location.

When the electric fan in use needs to be moved, a small fan is moved by lifting itself up while a large one is moved dragged on the floor, so that such moving the fan is inconvenient and trouble some, and a bottom surface of a fan body could be damaged.

Though there is a fan having a caster on the bottom surface, user should push or pull the fan to move and its moving direction is not controlled as desired.

DISCLOSURE OF INVENTION

The present invention is contemplated to solve the aforementioned problem, and it is an object of the present invention to provide driving means for moving a electric fan which comprises a driving ball for moving the fan body, at least four driving roller disposed around the driving ball, and a motor and coil for operating the driving roller selectively, so that the fan could be moved to the desired position conveniently with only a selective control of the power transmission between the driving ball 10 and driving roller 11 by simple operation of a remote controller and thereby the convenience in using the fan is increased and the entire value of the fan is also increased.

To accomplish the above object, an electric fan for moving automatically according to the present invention comprising: a driving ball installed to rotate freely in the center of a bottom surface of a fan body, for moving the fan body; at least four driving, rollers disposed around the driving ball, for rolling the driving ball with being contact with and separate from; and a motor and transmission members for giving the power to each driving roller simultaneously, wherein due to selective power transmission between one or two driving roller and the driving ball, the fan body could moves in forward, backward, right, left, and diagonal direction.

More particularly, the driving roller includes: a roller shaft having a driving bevel gear at one end there of and a wound coil provided with the electric current; a driving drum made of two pieces coupled on and rotating together with the roller shaft, and able to expand in its radial direction according to the magnetization of the coil; and disc clutches coupled to both ends of the roller shaft so as to rotate together and coupled to both end surfaces of the driving drum using pin and slot so as to guide the expansion of the driving drum; and roller brackets fixed to the bottom surface of the fan body and supporting both ends of the roller shaft.

The transmission members preferably includes: a supporting rod installed perpendicularly to the bottom surface of the fan body; an transmitting pulley coupled to an upper end of the supporting rod to rotate together with the supporting rod, and connected with a motor pulley mounted at a shaft of motor by a belt; and a transmitting bevel gear coupled to an lower end of the supporting rod to rotate together with the supporting rod, and engaged with driving bevel gear in the roller shaft of the driving roller so as to transmit the power.

In addition, the transmission member preferably includes: a supporting rod installed perpendicularly to the bottom surface of the fan body; a transmitting gear coupled to an upper end of the supporting rod to rotate together with the supporting rod, and engaged directly with a driving gear mounted at the shaft of the motor; a transmitting bevel gear coupled to an lower end of the supporting rod to rotate together with the supporting rod, and engaged with driving bevel gear in the roller shaft of the driving roller so as to transmit the power.

Meanwhile, four driving rollers are disposed around the driving ball at a mutual angle of 90°, and two opposite driving rollers have rotating directions, which are inverse each other.

Furthermore, the coil includes dual coils, which are wound on the roller shaft independently, and each coil is provided with a contact point which could always contact with the rotating roller shaft.

BRIEF DESCRIPTION OF DRAWINGS

The features and advantages of the present invention will be more described specifically in the following description of preferred embodiments of the invention with reference to the accompanying drawings wherein.

BEST MODE FOR CARRYING OUT THE INVENTION

Figure 1:
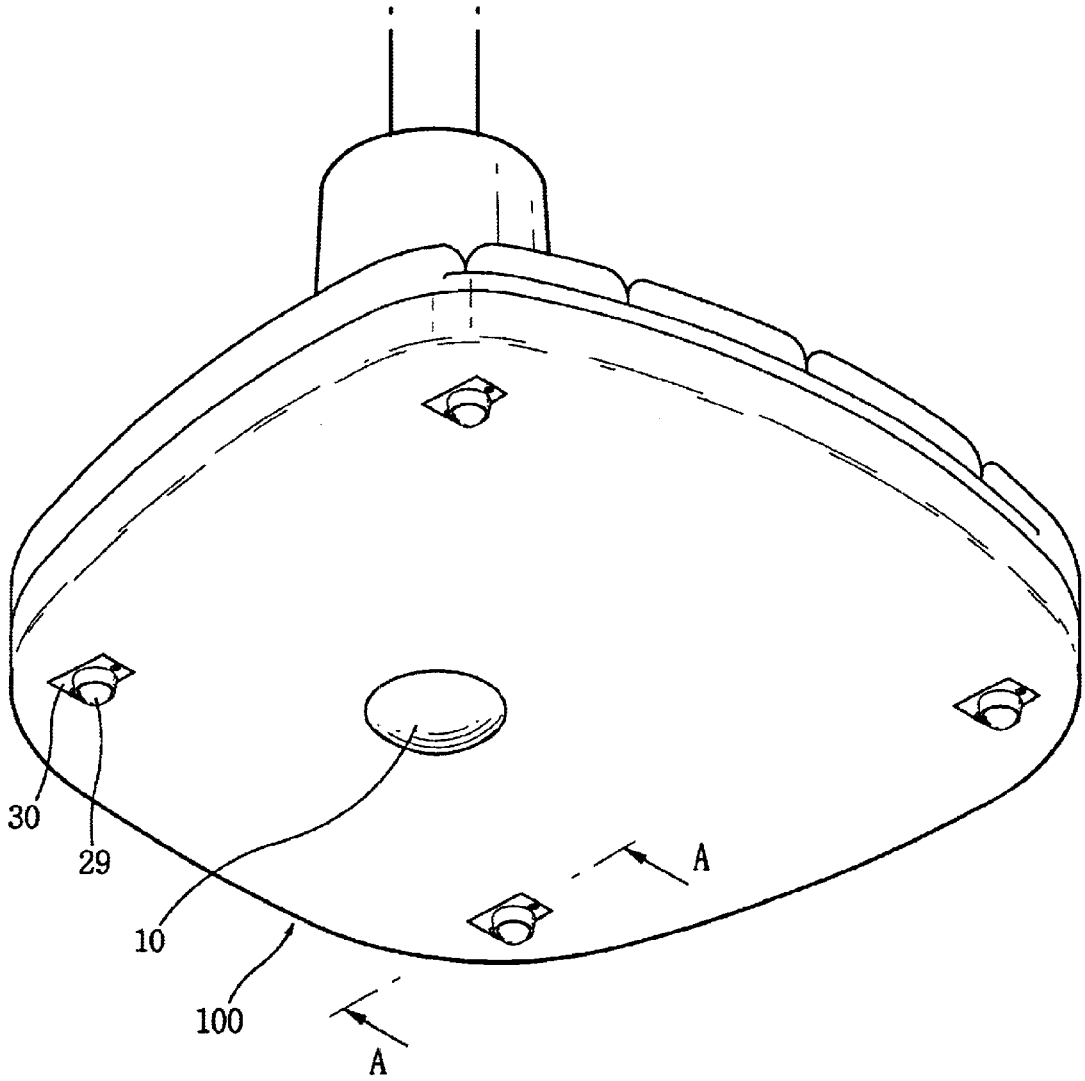
FIG. 1 is a perspective view showing a bottom surface structure of a fan according to the present invention.

Reference will now be made in detail to the embodiment of the present invention and examples of which are illustrated in the accompanying drawings. In explaining the present invention, the same names and reference numerals will be given to the same components, and explanations in the same will be omitted.

FIG. 1 is a perspective view showing a bottom surface structure of a fan according to the present invention.

A driving ball 10 is installed in the center of a bottom surface of a fan body 100, and the fan body 100 could move according to the movement of this driving ball 10, guided by guide balls 29 in the four corners.

Figure 6:
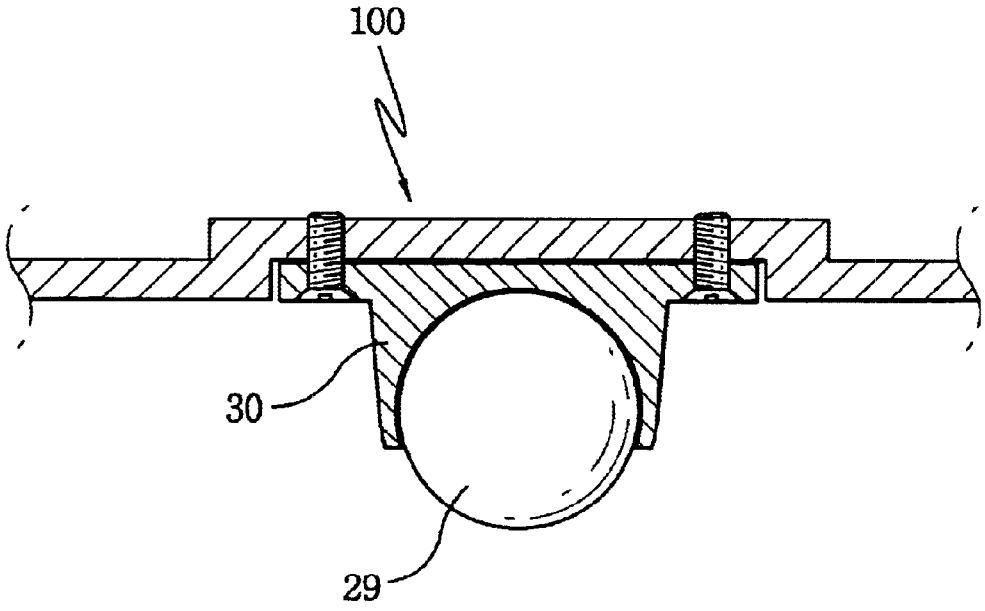
FIG. 6 a sectional view showing a mounting structure of a guide ball in the fan according to the present invention, taken along line A—A of FIG. 1.

Each guide ball 29, as shown in FIG. 6 is installed to rotate freely in a ball bracket 30, which is fixed on the bottom surface of the fan body 100. Therefore, the guide balls 29 could guide the movement of the fan body 100 stably, regardless of the moving direction of the driving ball 10.

Figure 2:
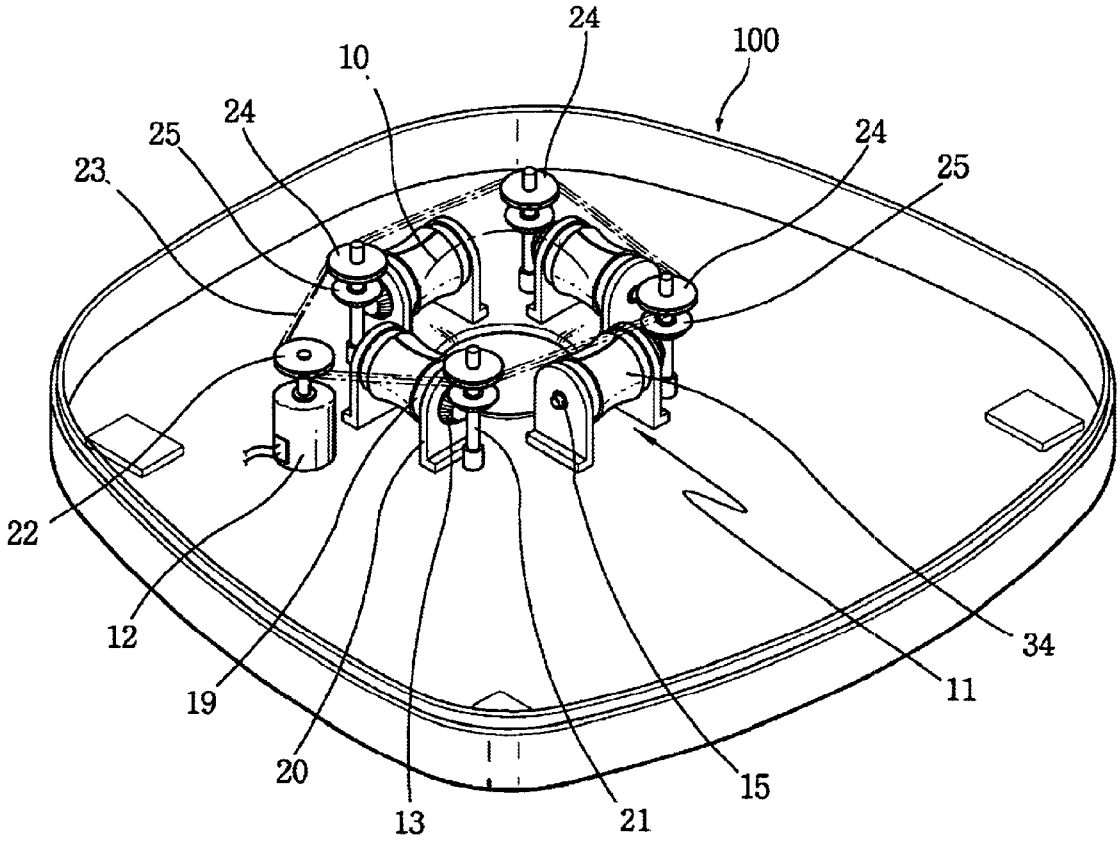
FIG. 2 is a perspective view showing driving means of the fan according to the present invention.

FIG. 2 is a perspective view showing driving means of the fan according to the present invention.

The driving means comprises four driving rollers 11 disposed around the driving boll 10 and a motor 12/transmission members for giving the power to these driving rollers 11.

Each driving roller 11 could be rotated with the operation of single motor 12, and allows the driving ball 10 to roll in any direction, with being contact with and separated from the driving ball 10 selectively according to predetermined controlling mode.

Figure 3:
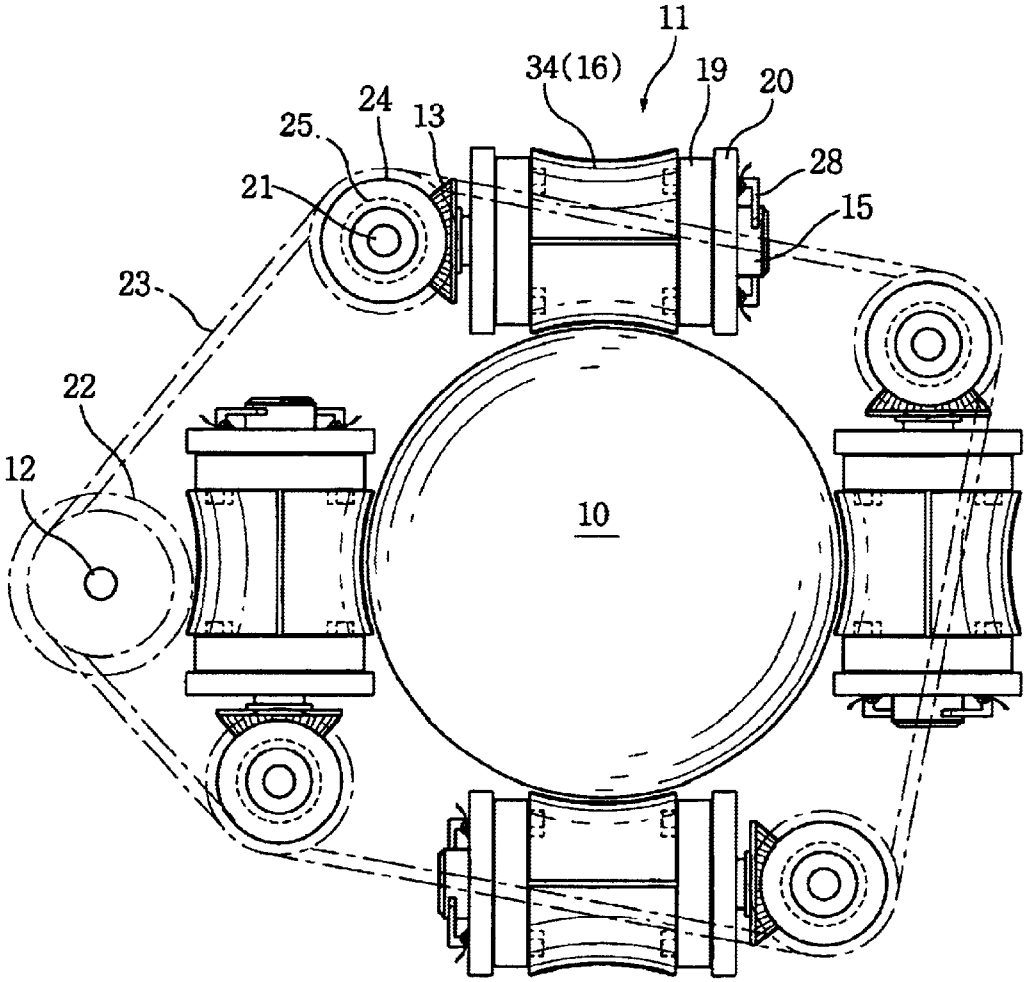
FIG. 3 is a plan view showing an operating relation of the driving means in the fan according to the present invention.

For this, as shown in FIG. 3, four driving roller Is are disposed close to the driving ball 10 at a mutual angle of 90° along a circumference of the driving ball 10, one transmission member is installed for each driving roller 11, and each driving roller 11 is connected through the transmission member with a belt 23 extending from the motor 12 in one side. Accordingly, when the motor 11 is operated, each driving roller 11 could rotate, the power being transmitted to each transmission member by the belt 23.

That is, four driving roller 11 could always rotate simultaneous with the operation of the motor 12, and if it is not intended to move the fan, each driving roller 11 merely rotates neutrally and the power transmission to the driving ball 10 is not established.

Two opposite driving rollers 11 have rotating directions which are inverse each other, so that the driving ball 10 could roll in forward, backward, right, and left direction by independent power transmission of individual driving roller 11 and in diagonal direction by cooperated power transmission of two adjacent driving rollers 11.

In one embodiment of the present invention, the transmission members comprises an upper pulley 24 for transmitting the power by a belt, a lower bevel gear 25 for transmitting the power to the driving roller 11 by a gear, and a supporting rod fixed perpendicularly to the bottom surface of the fan body 100 for supporting the pulley 24 and bevel gear 25.

It is possible to transmit the power with a chain by applying a sprocket instead of the pulley.

Figure 4:
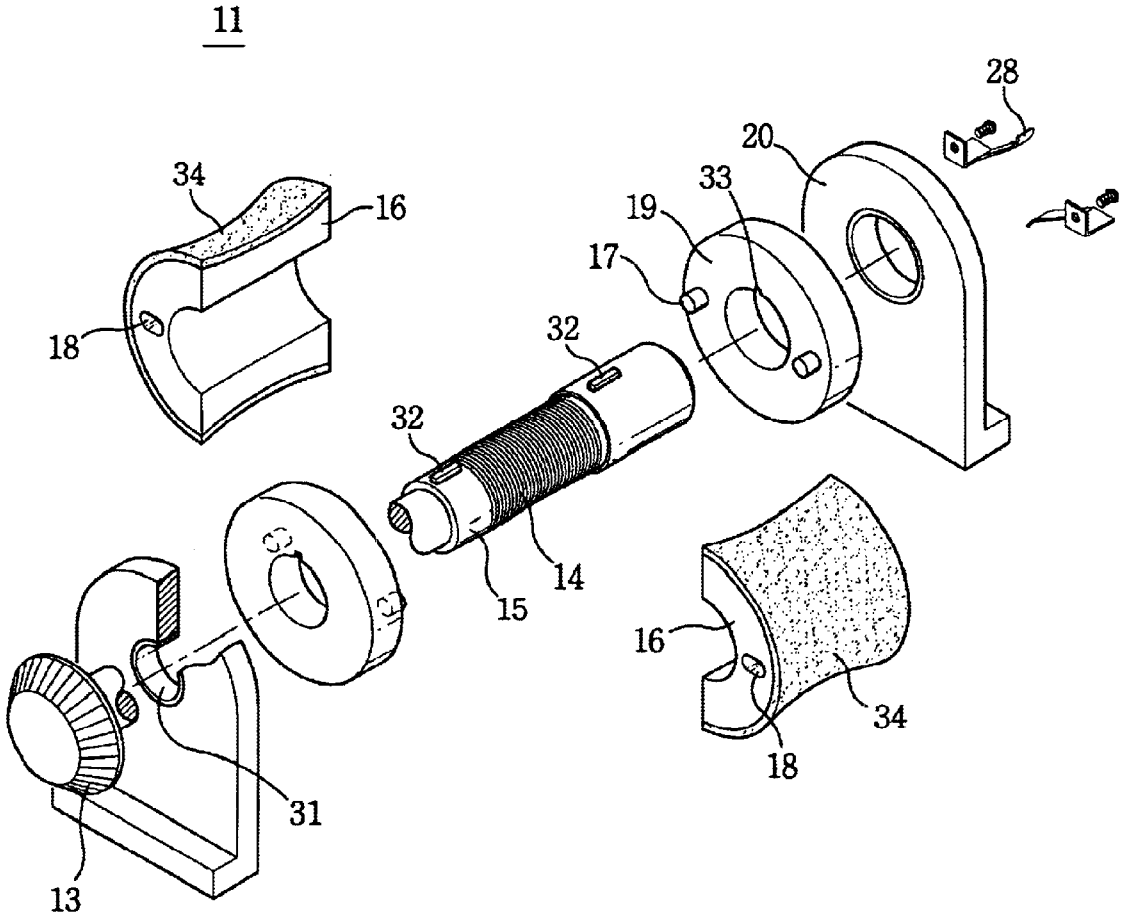
FIG. 4 is an exploded perspective view showing a driving roller in the driving means of the fan according the present invention.

FIG. 4 is an exploded perspective view showing a driving roller in the driving means of the fan according the present invention, In the driving roller 11, a roller shaft 15 is installed rotatable by bearings 31, between two roller bracket 20 fixed to the bottom surface of the fan body 100, disc clutches 19 are coupled to both ends of the roller shaft 15 inside of the roller bracket 20, using keys 32 and key grooves 33 so as to rotate together with the roller shaft 15, and a driving drum 16 made of two pieces surrounds a circumference surface of the roller shaft 15.

While the roller shaft 15 could rotate by the power transmitted through the bevel gear 13 mounted one end thereof, the driving drum 16 is coupled by inserting pins 17 projecting from an inner surface of the disc clutches 19 into a slots 18 in both end surfaces thereof and driving drum 16 could expand from the roller shaft 15 guided by pins 17 moving in a free space of slots 18.

This expansion of the driving drum 16 is achieved by magnetic characteristics of a coil 14 wound on the roller shaft 15.

Figure 5:
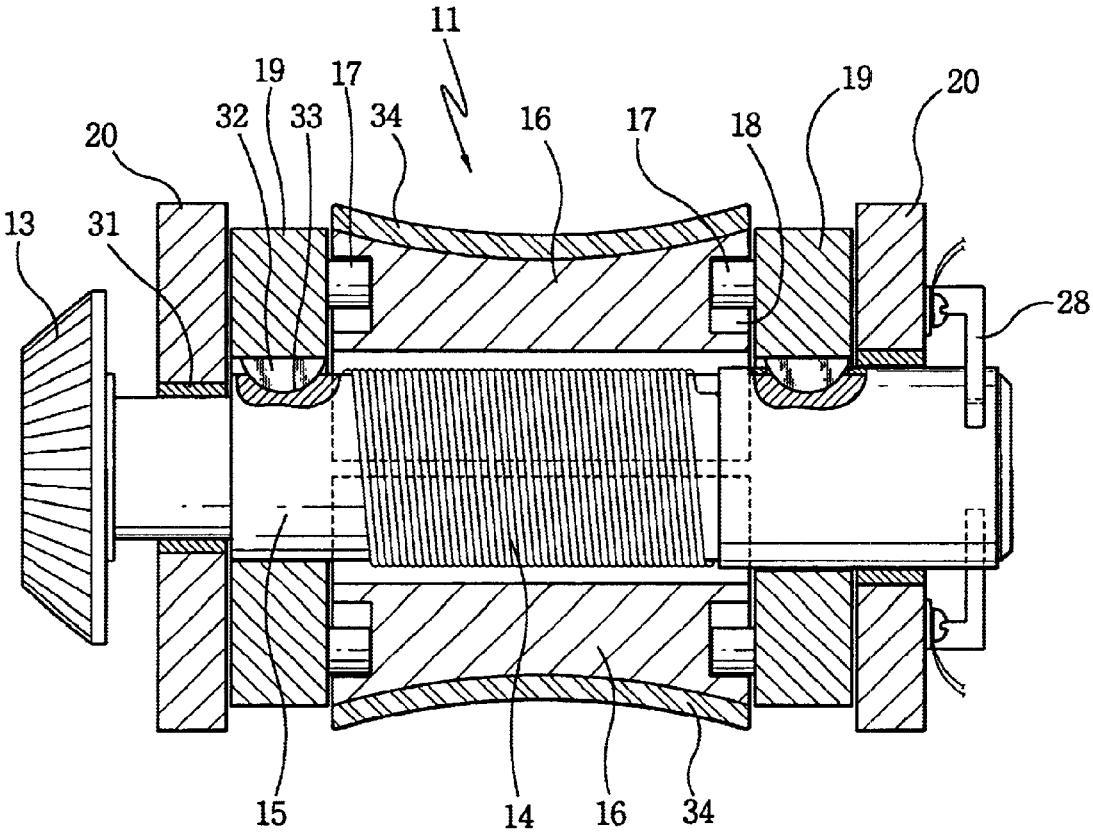
FIG. 5 is a sectional view showing a state before the contact of the driving roller in the driving means of the fan according the present invention.
Figure 7:
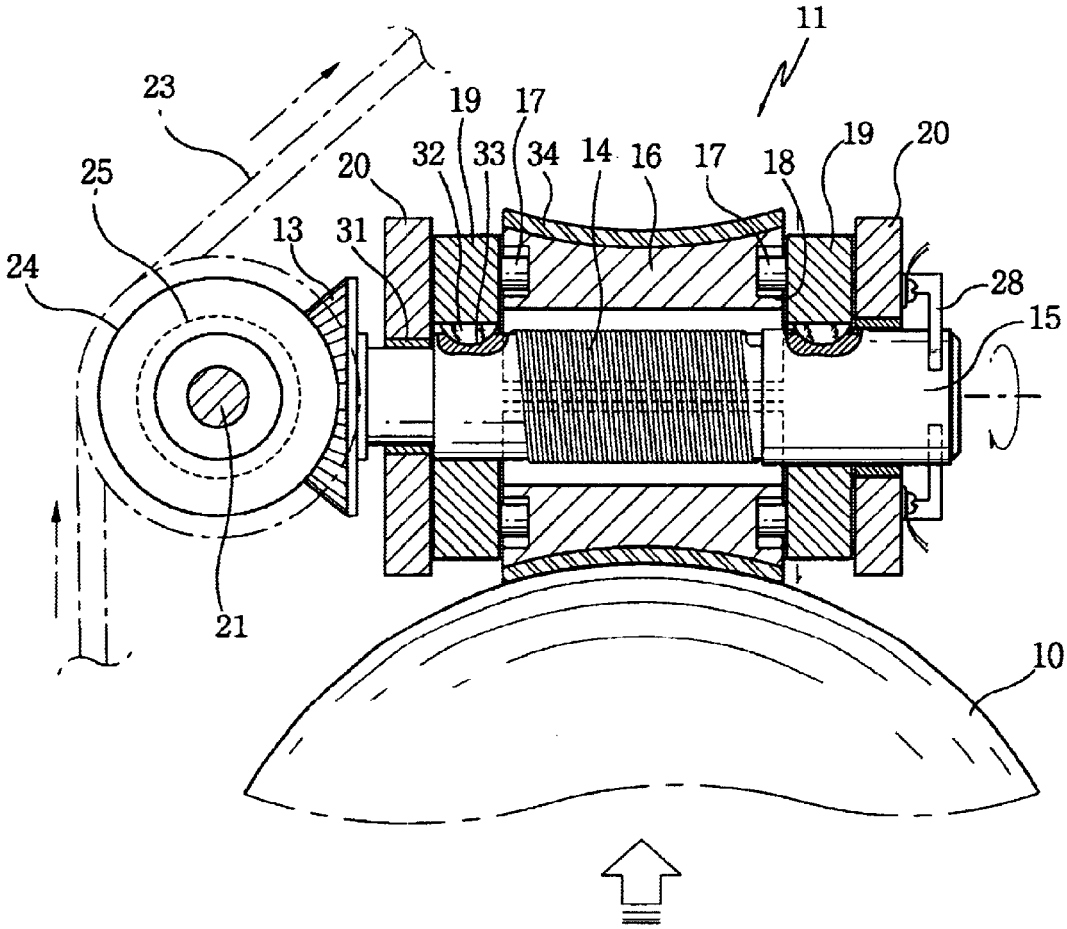
FIG. 7 is a sectional view showing a state after the contact of the driving roller in the driving means of the fan according the present invention.

That is, two bundle of coil having respective contact point 28 are wound on the roller shaft 15 separately. When the electric current is provided to this coil, the repulsive force occurs between the coil 14 and driving drum 16 and as shown in FIG. 7, the pieces of the driving drum 16 move outward respectively. When the electric current is not provided any more, the attractive force occurs between the coil 14 and the driving drum 16 and as shown in FIG. 5, the pieces of the driving drum 16 move toward the roller shaft 15.

Also, the surface of the driving drum 16 is coated with a layer of rubber having good friction characteristics, so that the reduction of the power transmission efficiency in contacting with the driving ball 10 is prevented maximally.

Figure 8:
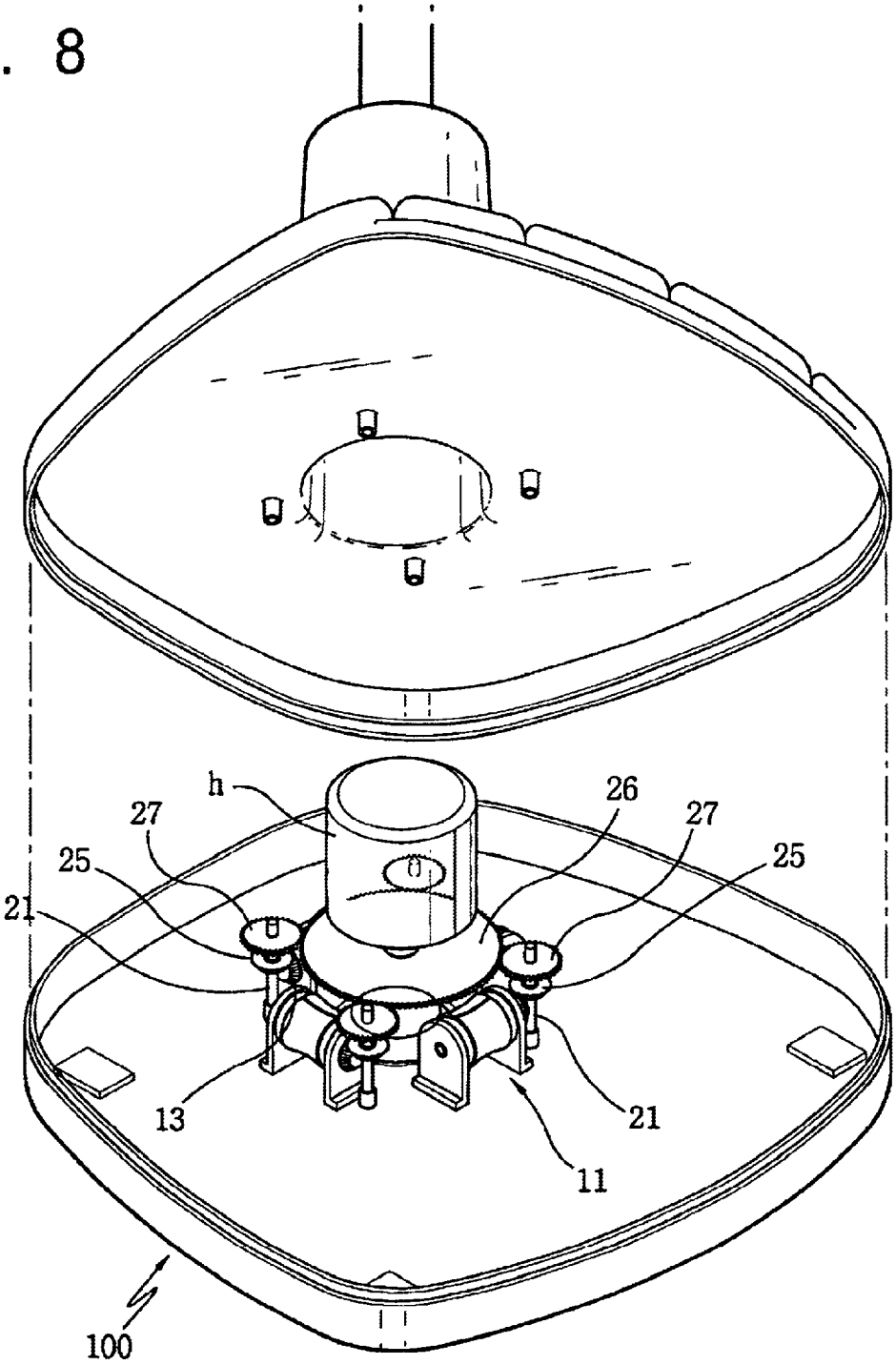
FIG. 8 is a perspective view showing another embodiment of the driving means of the fan according to the present invention.
Figure 9:
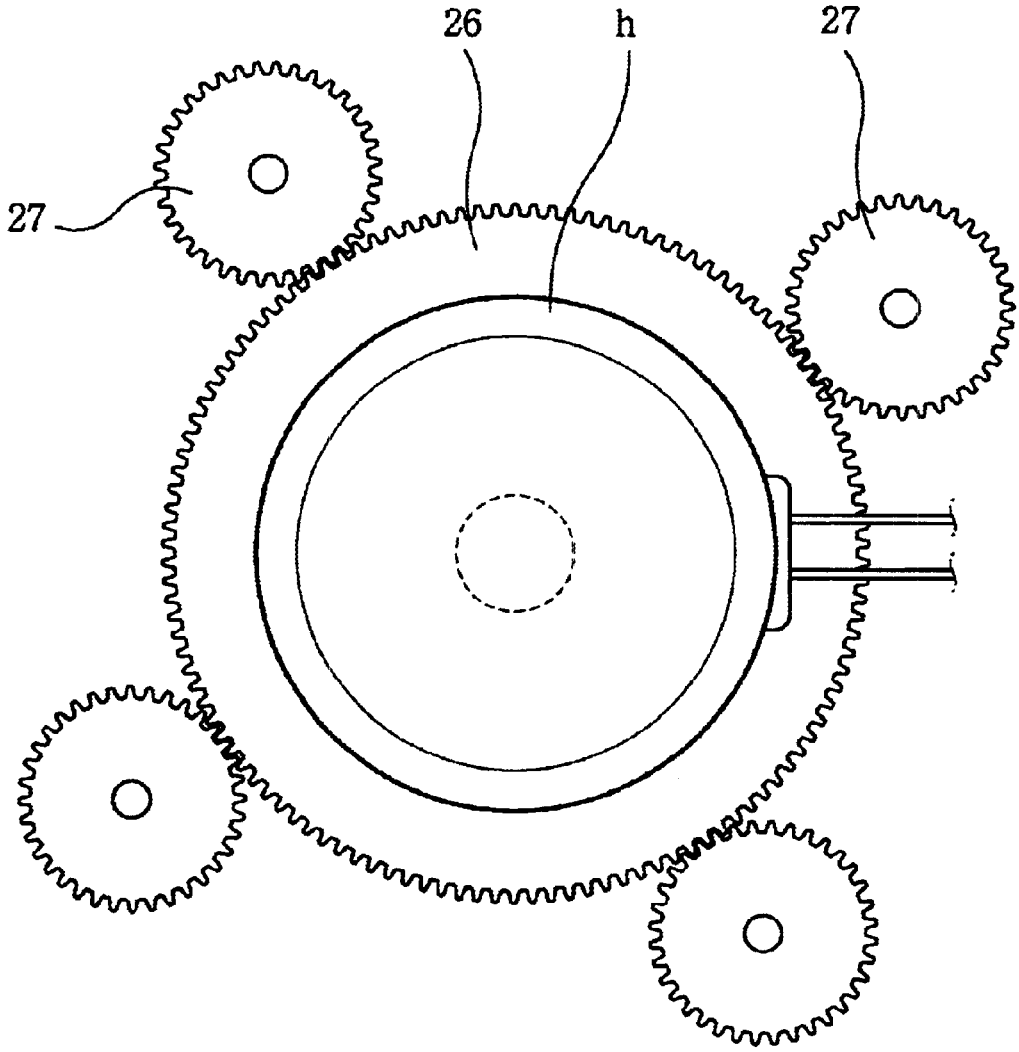
FIG. 9 is a partly enlarged plan view of FIG. 8.

FIG. 8 and FIG. 9 illustrate another embodiment of the driving means of the fan according to the present invention.

A motor 12 is installed using an inner space of a column in a fan body 100, a driving gear 26 is mounted on a shaft of the motor 12, and transmission gears 27 which engages simultaneously with the driving gear 26 at corresponding positions, are mounted to upper end of supporting rod 21. Therefore, the movement of the fan using gear transmission could be possible.

The operation of the fan according to the present invention will be explained in detail as follows.

To move the fan to desired position, the motor 12 is operated by pressing ON/OFF switch of a remote controller (not shown) firstly.

Though the motor 12 is operated, each driving roller 11, as shown in FIG. 5 maintains the neutral state, as the driving drum 16 is located close to the roller shaft 15 and forms a fixed distance against the driving ball 10.

When corresponding driving roller 11 is provided with the electric current by pressing forward/backward, right/left or diagonal direction switch, the driving drum 16 expands outward and sticks to driving ball 10, as shown in FIG. 7 by the magnetic characteristics of the coil 14. Accordingly, the driving force of the motor 12 is transmitted to the transmission bevel gear 25 and driving bevel gear 13 through the belt 23, and then the driving roller 11 rolls the driving ball 10 while rotate, so that the fan could be moved to the desired direction.

Referring to FIG. 3, the moving direction of the fan will be explained.

When a lower one of the four driving roller 11 is operated, the fan moves downward direction in the drawing, and when a right one is operated, the fan moves right direction in the drawing.

To move the fan to diagonal direction, that is the direction between the right and lower directions, the right and lower driving roller 11 are operated and roll the driving ball 10 together.

Regarding the direction not mentioned above, the fan is moved to any direction if the corresponding driving rollers 11 are operated separately or together.

The Industrial Applicability

As explained above, the present invention provides the electric fan, which could be moved to the desired position conveniently by simple operation of a remote controller so that the convenience in using the fan is increased and thereby the entire value of the value of the fan is also increased.

What is claimed is:

1. A electric fan for moving automatically comprising:

a driving ball 10 installed to rotate freely in the center of a bottom surface of a fan body, for moving the fan body;

at least four driving rollers 11 disposed around the driving ball 10, for rolling the driving ball 10 with being contact with and separate from; and a motor 12 and transmission members for giving the power to each driving roller 11 simultaneously, wherein due to selective power transmission between one or two driving roller 11 and the driving ball 10, the fan body could moves in forward, backward, right, left, and diagonal direction.

2. A fan according to claim 1, wherein the driving roller 11 includes:

a roller shaft 15 having a driving bevel gear 13 at one end thereof and a wound coil 14 provided with the electric current;

a driving drum 16 made of two pieces coupled on and rotating together with the roller shaft 15, and able to expand in its radial direction according to the magnetization of the coil 14; and disc clutches 19 coupled to both ends of the roller shaft 15 so as to rotate together and coupled to both end surfaces of the driving drum 16 using pin 17 and slot 18 so as to guide the expansion of the driving drum 16; and roller brackets 20 fixed to the bottom surface of the fan body and supporting both ends of the roller shaft 15.

3. A fan according to claim 1, wherein the transmission members includes:

a supporting rod 21 installed perpendicularly to the bottom surface of the fan body;

an transmitting pulley 24 coupled to an upper end of the supporting rod 21 to rotate together with the supporting rod 21, and connected with a motor pulley 22 mounted at a shaft of motor 12 by a belt 23, and a transmitting bevel gear 25 coupled to an lower end of the supporting rod 21 to rotate together with the supporting rod 21, and engaged with driving bevel gear 13 in the roller shaft 15 of the driving roller 11 so as to transmit the power.

4. A fan according to claim 1, wherein the transmission member includes:

a supporting rod 21 installed perpendicularly to the bottom surface of the fan body;

a transmitting gear 27 coupled to an upper end of the supporting rod 21 to rotate together with the supporting rod 21, and engaged directly with a driving gear 26 mounted at the shaft of the motor 12;

a transmitting bevel gear 25 coupled to an lower end of the supporting rod 21 to rotate together with the supporting rod 21, and engaged with driving bevel gear 13 in the roller shaft 15 of the driving roller 11 so as to transmit the power.

5. A fan according to claim 1, wherein four driving rollers 11 are disposed around the driving ball 10 at a mutual angle of 90°, and two opposite driving rollers 11 have rotating directions which are inverse each other.

* * * * *